US005611190A

United States Patent [19]

Van Merksteijn

[11] Patent Number: 5,611,190

[45] Date of Patent: Mar. 18, 1997

[54] METAL ROD AND A METHOD FOR MANUFACTURING SAME

[76] Inventor: Jacobus L. Van Merksteijn, Veldmolen 10, NL-7491 GN, Delden, Netherlands

[21] Appl. No.: 537,406

[22] Filed: Oct. 2, 1995

Related U.S. Application Data

[63] Continuation of Ser. No. 164,196, Dec. 8, 1993, abandoned.

[30] Foreign Application Priority Data

Dec. 9, 1992 [NL] Netherlands ..... 9202127

[51] Int. Cl.[6] ..... E04C 3/30

[52] U.S. Cl. ..... 52/740.3; 52/740.4; 72/194

[58] Field of Search ..... 52/740.3, 740.4, 52/740.5, 740.2; 72/194, 252.1, 111

[56] References Cited

U.S. PATENT DOCUMENTS

| | | | |
|---|---|---|---|
| 1,404,198 | 1/1922 | Gerson | 52/740.4 |
| 1,514,806 | 11/1924 | Thomas | 52/740.4 |
| 3,186,206 | 6/1965 | Gillberg | 72/194 |
| 3,641,799 | 2/1972 | Wildt | 52/737 X |
| 4,137,686 | 2/1979 | Kern | 52/734 |

FOREIGN PATENT DOCUMENTS

| | | | |
|---|---|---|---|
| 0505850 | 9/1954 | Canada | 52/737 |
| 0721484 | 11/1965 | Canada | 52/740.2 |
| 0399910 | 11/1990 | European Pat. Off. . | |
| 0040902 | 6/1966 | Germany | 52/737 |
| 1813177 | 12/1968 | Germany . | |
| 2704819 | 8/1978 | Germany . | |
| 0582304 | 9/1958 | Italy | 52/737 |
| 1058863 | 2/1967 | United Kingdom . | |
| 1146651 | 3/1969 | United Kingdom | 52/737 |
| 8910804 | 11/1989 | WIPO . | |

OTHER PUBLICATIONS

Catalog "Type of Deformed Bars Used in Pull–Out Tests", p. 4, Jun., 1947.

*Primary Examiner*—Carl D. Friedman
*Assistant Examiner*—Winnie Yip
*Attorney, Agent, or Firm*—Webb Ziesenheim Bruening Logsdon Orkin & Hanson, P.C.

[57] ABSTRACT

The invention relates to metal rod with a substantially round cross section comprising at least six rows of ribs arranged in the surface spread over the periphery, the surface of which is preferably provided with six rows of ribs and the ribs of at least one row are optionally arranged obliquely in the surface relative to the rod direction, wherein the ribs of adjoining rows of ribs are optionally oriented in herringbone form.

10 Claims, 2 Drawing Sheets

METAL ROD AND A METHOD FOR MANUFACTURING SAME

This is a continuation of application Ser. No. 08/164,196 filed on Dec. 8, 1993, abandoned.

BACKGROUND OF THE INVENTION

1. Field of the Invention

The present invention relates to metal rods, in particularly steel rods used in the building industry in concrete constructions.

2. Description of the Prior Art

It is important that the metal rod has good adhesion to concrete. The adhesion of metal rod to concrete can be improved by providing the metal rod with ribs, wherein eventually the ratio of the rib surface over the peripheral surface is a measure of the concrete adhesion ($f_r$ value). The metal rod must nevertheless have the smoothest possible external surface in order to minimize wear of metal rod processing machines and to enable optimal handling. Care must be taken that the processed metal rod has a round, preferably circular, cross section.

SUMMARY OF THE INVENTION

According to the present invention metal rod with an adequate concrete adhesion is obtained if the metal rod comprises at least six rows of ribs arranged on the rod surface and spread over the periphery. By arranging six or more rows of ribs in a of the rod substantially symmetrical distribution along a longitudinal direction on the periphery, not only can the rib height remain relatively small but deformation of the cross sectional form is substantially avoided.

Optimum concrete adhesion is obtained when the surface of the metal rod is provided with six rows of ribs.

In order to avoid torsion in the metal rod during production and to achieve maximum concrete adhesion, it is recommended that the ribs of adjoining rows of ribs are oriented in herringbone form.

The present invention likewise relates to a method for manufacturing metal rod which is provided with at least six rows of ribs arranged on the rod surface and spread over its periphery. This method is characterized in that the rows of ribs are arranged on the surface of the metal rod in two successive rolling operations, that is, first three or more rows of ribs followed by three or more rows of ribs in the remaining original surface of the metal rod.

Because the forming of he ribs in the surface of the metal rod can result in cross sectional deformations and possible flow of the metal rod, it is recommended that for the first rolling operation the rollers are provided with a convex rolling surface. Ribs are thus formed under pressure with the rollers of the first rolling operation whereby an outward deforming occurs forming a concave recess in the adjoining portions of the original surface of the metal rod, which is preferably counteracted by using rollers for the second rolling operation which are provided with a flat rolling surface.

It is thus possible to provide metal rod having a quality substantially the same as hot-rolled metal rod.

These and other features of the metal rod and the method for manufacturing thereof will be further elucidated hereinafter in the light of a non-limitative embodiment only given by way of example.

DESCRIPTION OF THE PREFERRED EMBODIMENTS

Figure 1:
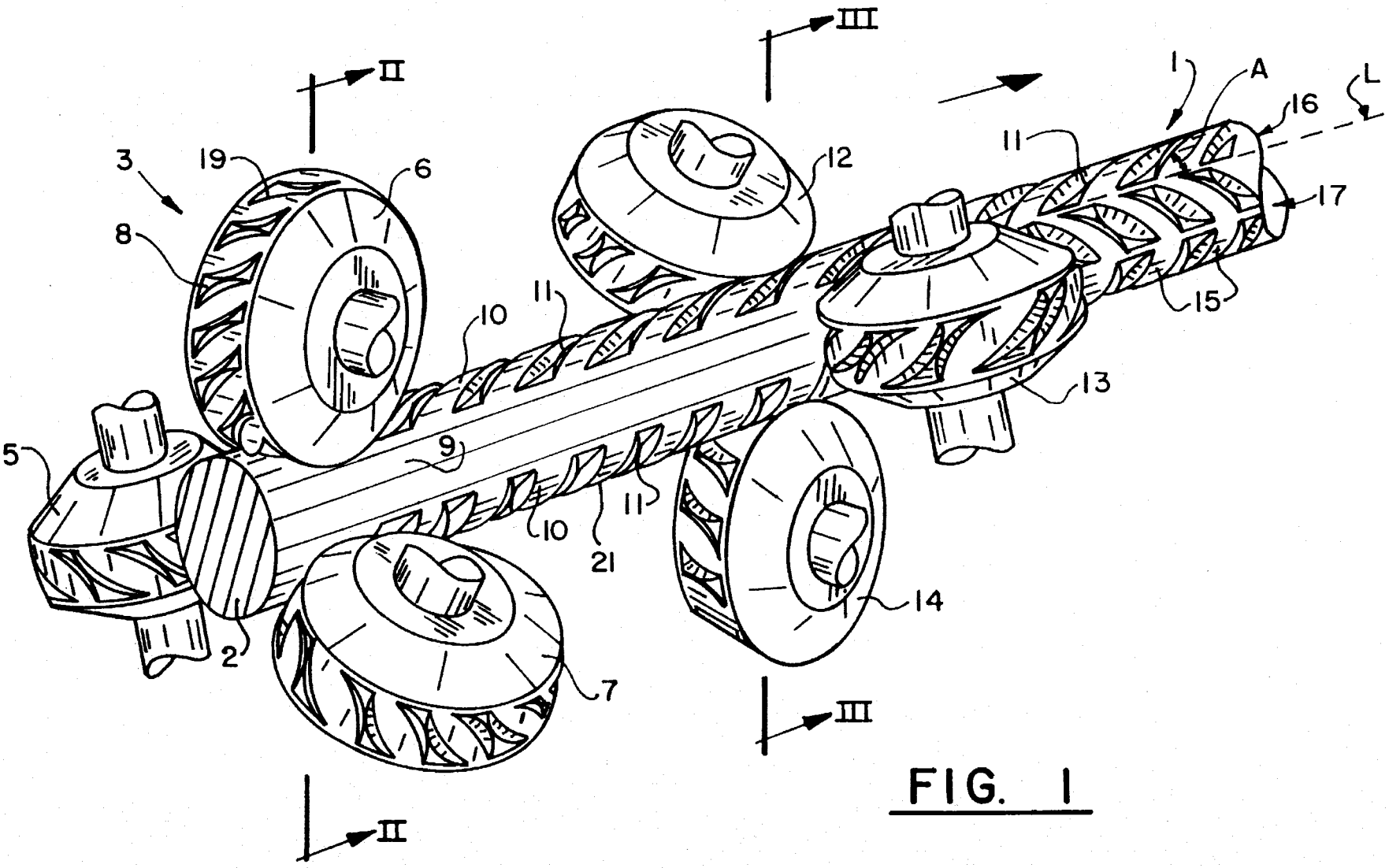
FIG. 1 shows a perspective view of the two rolling operations used for manufacturing a metal rod according to the invention.

FIG. 1 shows the manufacture of a metal rod 1 for example, a steel rod, according to a preferred embodiment of the invention by processing a substantially circular metal rod 2 in two rolling stations 3 and 4.

The rolling station 3 comprises three rollers 5–7 which are disposed in mutual rotational symmetry and are each provided with a rolling profile 8 for forming on the surface 9 of the metal rod 2 ribs 10 which are mutually separated by recesses 11.

In the second rolling station 4 ribs 15 are formed in the remaining original portions of the surface 9 in similar manner using three rollers 12–14.

The rollers 12–14 of rolling station 4 are likewise disposed in rotational symmetry.

Ribs 10 and 15 of mutually adjacent rows 16 and 17 each lie obliquely, preferably at an angle A of 30°–50°, more preferably 40°, to the rod direction L such that a so-called herringbone form is created. The oblique orientation in the surface 9 not only avoids torsion but also reduces the notch effect.

Figure 2:
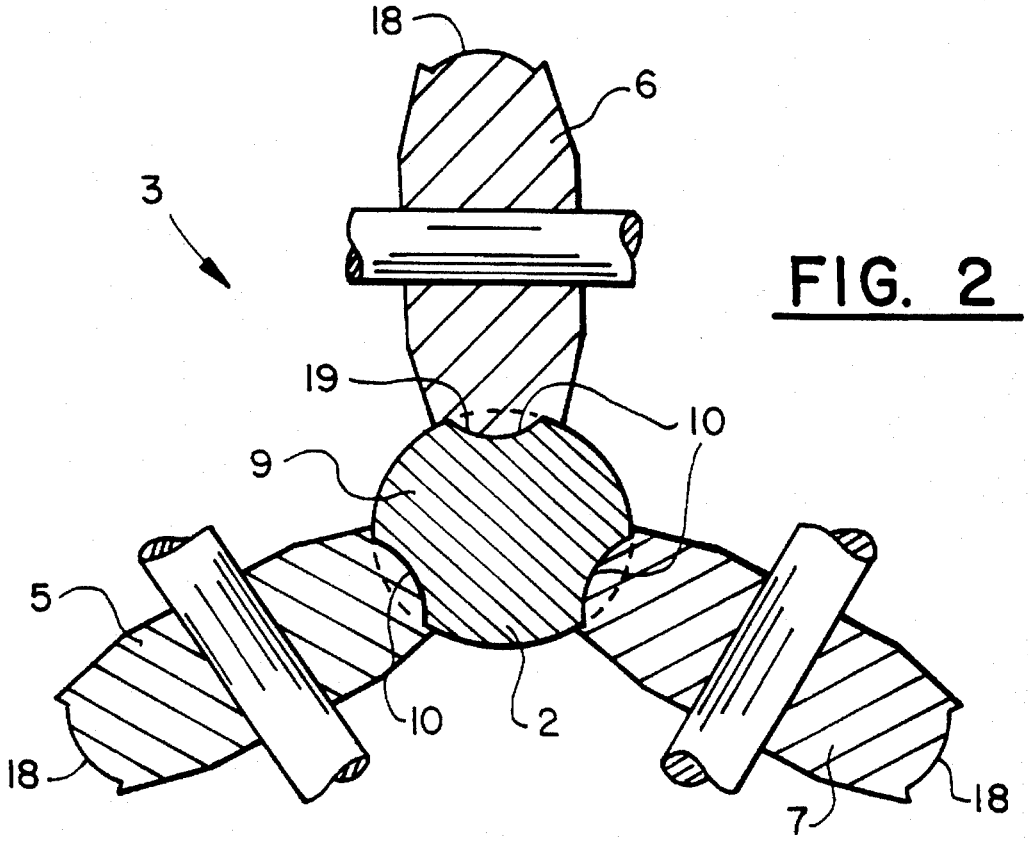
FIGS. 2 and 3 show a cross sectional view respectively along the line II—II and the line III—III of FIG. 1.

FIG. 2 shows in more detail the rollers 5–7 of the first rolling station 3. Rollers 5–7 have a substantially convex rolling surface 18 in which are located recesses 19 so that ribs 10 and concave recesses 11 are formed. As shown in FIG. 2, the peripheral surface of the rod includes a bottom surface of each recess 11 having a concave profile along a plane parallel to adjacent ribs 10. Additionally, as shown in FIG. 1, each recess 11 includes two opposed curved side surfaces extending down from adjacent ribs 10.

Figure 3:
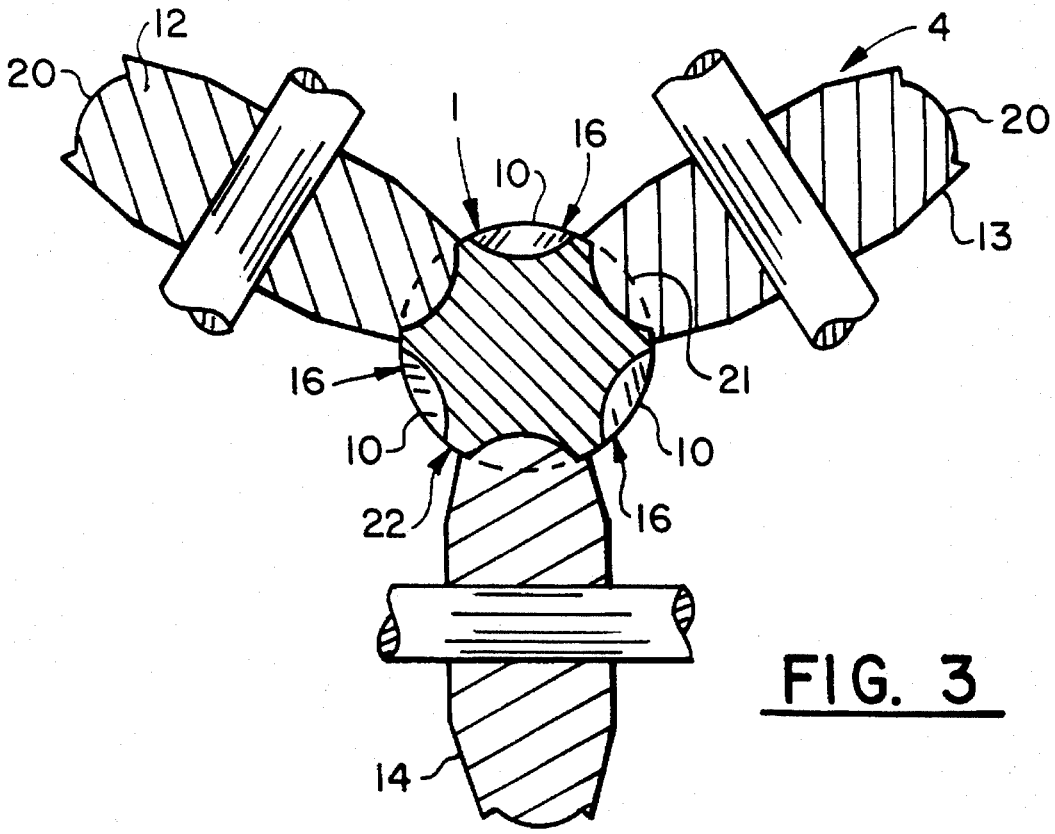

The rollers 12–14 of rolling station 4 have, as shown in FIG. 3, a flat rolling surface 20 with recessed indentations 21 for forming of the ribs 15 for the eventual rows 17.

As shown in FIGS. 1 and 3, the metal rod 1 has arranged thereon six rows of ribs 16, 17 spread over its periphery.

In preference the rows 16, 17 are arranged around such that in the finished metal rod 1 there remains substantially no free surface 22.

I claim:

1. A metal rod comprising:

a substantially round cross section having at least six rows of ribs arranged on a peripheral surface of said rod;

said ribs of each row defining parallel planes which are at an oblique angle to said substantially round cross section; and at least one recess disposed between adjacent ribs in each said row of ribs, wherein said recess in alternating rows of ribs is substantially concave having a concave profile in a plane parallel to said parallel planes of said ribs of said alternating rows, whereby said peripheral surface of said rod includes a bottom surface of said recess having said concave profile and wherein each said recess includes two opposed curved side surfaces extending down from said adjacent ribs to define said concave profile.

2. The metal rod as claimed in claim 1, wherein the surface is provided with six rows of ribs.

3. The metal rod as claimed in claim 2, wherein the ribs are arranged obliquely on the surface relative to a rod longitudinal direction.

4. The metal rod as claimed in claim 3, wherein the ribs of adjoining rows of ribs are oriented in a herringbone shape.

5. A method rod as claimed in claim 1, wherein the ribs are arranged obliquely on the surface relative to a rod longitudinal direction.

6. The metal rod as claimed in claim 5, wherein the ribs of adjoining rows of ribs are oriented in a herringbone shape.

7. The metal rod as claimed in claim 1, wherein said ribs of any row do not overlap said ribs of any other row and said recesses of any row do not overlap said recesses of any other row.

8. A metal rod comprising a plurality of rows of ribs disposed on a surface of said rod, and said rows extending along a longitudinal direction on said surface of said rod, said ribs of each row forming an angle with respect to said longitudinal direction of between about 30°–50° which define parallel planes through a substantially round cross section of said rod, and at least one recess disposed between adjacent ribs in each said row of ribs, wherein said recesses in alternating rows of ribs are substantially concave having a concave profile in a plane parallel to said parallel planes of said ribs of said alternating rows and said ribs form a herringbone pattern, said concave profile plane forming an angle of between about 30°–50° with respect to said longitudinal direction whereby said peripheral surface of said rod includes a bottom surface of said recess having said concave profile and wherein each said recess includes two opposed curved side surfaces extending down from said adjacent ribs to define said concave profile.

9. The metal rod of claim 8, wherein said ribs of each row form an angle of 40° with respect to said longitudinal direction.

10. The metal rod as claimed in claim 8, wherein said ribs of any row do not overlap said ribs of any other row and said recesses of any row do not overlap said recesses of any other row.

* * * * *

UNITED STATES PATENT AND TRADEMARK OFFICE

CERTIFICATE OF CORRECTION

PATENT NO. : 5,611,190

DATED : March 18, 1997

INVENTOR(S) : Jacobus L. Van Merksteijn

It is certified that error appears in the above-indentified patent and that said Letters Patent is hereby corrected as shown below:

Column 1 Line 30 after "periphery" insert --of the rod--.

Column 1 Line 31 before "substantially" delete --of the rod--.

Column 1 Line 50 "he ribs" should read --the ribs--.

Column 1 Line 50 "in the surface" should read --on the surface-.

Column 2 Line 1 "DRAWING" should read --DRAWINGS--.

Column 2 Line 11 "EMBODIMENTS" should read --EMBODIMENT--.

Claim 5 Column 3 Line 10 "A method rod" should read --The metal rod--.

Claim 8 Column 3 Line 20 after "rod," delete --and--.

Signed and Sealed this

Fifteenth Day of July, 1997

Bruce Lehman

*Attest:*

BRUCE LEHMAN

*Attesting Officer*

*Commissioner of Patents and Trademarks*